US005339099A

United States Patent [19]

Nureki et al.

[11] Patent Number: 5,339,099

[45] Date of Patent: Aug. 16, 1994

[54] LINE THERMAL PRINTER HAVING DRIVING PULSES OF VARIABLE PULSE WIDTH

[75] Inventors: Shinji Nureki; Kazuhisa Oonishi, both of Tokyo, Japan

[73] Assignee: Seiko Instruments Inc., Japan

[21] Appl. No.: 670,072

[22] Filed: Mar. 15, 1991

[30] Foreign Application Priority Data

Mar. 16, 1990 [JP] Japan ..... 2-67862

[51] Int. Cl.[5] ..... B41J 2/36

[52] U.S. Cl. ..... 346/76 PH

[58] Field of Search ..... 346/76 PH, 140; 400/120

[56] References Cited

U.S. PATENT DOCUMENTS 4,535,340 8/1985 Moriguchi et al. ..... 346/76 PH
4,590,487 5/1986 Noguchi et al. ..... 346/76 PH
4,616,941 10/1986 Nagai ..... 346/76 PH
4,814,787 3/1989 Doi ..... 346/76 PH
5,066,961 11/1991 Yamashita ..... 346/76 PH
5,109,235 4/1992 Sasaki ..... 346/76 PJ

FOREIGN PATENT DOCUMENTS 0064373 4/1984 Japan ..... 346/76 PH

*Primary Examiner*—Benjamin R. Fuller
*Assistant Examiner*—N. Le
*Attorney, Agent, or Firm*—Bruce L. Adams; Van C. Wilks

[57] ABSTRACT

This invention is directed to provide a line thermal printer which controls a power supply quantity to a thermal head by high speed control below a second unit and can insure always a predetermined printing density. The line thermal printer includes circuit elements for multiplying a heat accumulation counter for counting cumulatively the number of dot data for each line by a heat radiation constant in a predetermined cycle and for controlling a power supply pulse width on the basis of the count value of the heat accumulation counter.

18 Claims, 5 Drawing Sheets

LINE THERMAL PRINTER HAVING DRIVING PULSES OF VARIABLE PULSE WIDTH

BACKGROUND OF THE INVENTION

This invention relates to a line thermal printer, and more particularly to heat generation control of a line thermal head. A line thermal printer is equipped with a line thermal head having a structure wherein heat generation elements are arranged on a line for effecting thermal printing. Printing density depends on either the quantity of heat generated in the thermal head or the surface temperature of the heat generation elements. When printing is made in line sequence for each line, a thermometer is disposed in the proximity of the line thermal head in order to monitor the temperature change of the thermal head and to keep constant the printing density of each line. Power supplied to the heat generation elements is controlled in accordance with this monitored temperature change so as to keep the surface temperature constant.

In the heat generation control system of the line thermal head in the conventional line thermal printer such as described above, there is a difference between the actual surface temperature of the heat generation element and the detection temperature outputted from the thermometer. Since the heat generated from the heat generation elements is transferred to the thermometer through a radiation plate, a ceramic substrate, etc., of the thermal head, the thermometer is subject to a time delay in response. The detection temperature represents the result of integration of the heat of the thermal head as a whole and cannot follow a quick change below a second unit. For this reason, it has not been possible in the conventional line thermal printer to detect accurately the surface temperature of the heat generation elements of the thermal head on a real time basis and to feed back the detection result for controlling a power supply quantity. Thus, there is the problem that the printing density becomes unstable. About a few seconds' time is necessary, particularly from the start of heating of the thermal head to the response of the thermometer such as a thermistor. Another problem is that the printing density cannot be controlled for a few centimeters in terms of paper feed quantity from the start of printing.

BRIEF SUMMARY OF INVENTION

The present invention is directed toward providing a line thermal printer which can adjust a power supply output to a thermal head and can continuously guarantee a constant printing density by high speed control below a second unit. A brief summary of the invention will be explained with reference to FIG. 1. The line thermal printer has a line thermal head 1 which effects printing in line sequence in accordance with dot data representing image data and in response to a power supply pulse. The dot data designate selectively those heat generation elements to which power must be supplied among all the heat generation elements which are arranged on the line thermal head 1. A driving circuit 2 is connected to the line thermal head 1 and supplies selectively a power supply pulse to each heat generation element of the line thermal head 1 in accordance with the dot data. A dot data memory 3 is connected to the driving circuit 2 and stores temporarily the dot data for each line in synchronism with line sequence printing on the basis of image data supplied from an outside source. It also delivers the dot data to the driving circuit 2.

A heat accumulation counter 4 is connected to the dot data memory 3, measures the number of dot data for each line and counts the dot data cumulatively. A multiplier 5 is connected to the heat accumulation counter 4, multiplies repeatedly the count value of the heat accumulation counter 4 by a heat radiation constant in a predetermined cycle and corrects and updates the counted value. An arithmetic unit 6 is connected to the heat accumulation counter 4 and calculates the pulse width of the power supply pulse in synchronism with line sequence printing on the basis of the corrected and updated count value of the heat accumulation counter.

The output terminal of the arithmetic unit 6 is connected to the driving circuit 2 and controls the driving circuit 2 in accordance with its calculation result. The arithmetic unit 6 preferably includes means for calculating the power supply pulse width on the basis of the following relational formula $$t = t_0\left(1 - \frac{T}{aS}\right)$$

where

- t: power supply pulse width
- $t_0$: predetermined reference power supply pulse width
- T: corrected updated count value of heat accumulation counter
- S: predetermined saturation count value of heat accumulation counter
- a: predetermined constant.

A thermometer such as a thermistor 7 is disposed preferably in the proximity of the line thermal head 1 in order to detect the temperature of the line thermal head. The arithmetic unit 6 has means for deciding a predetermined reference pulse width $t_0$ on the basis of the temperature detection result of the thermistor 7. The line thermal head 1 is preferably divided into a plurality of blocks, and the driving circuit 2, the dot data memory 3 and the heat accumulation counter 4 are divided into blocks or units corresponding to the thermal head blocks. The arithmetic unit 6 includes means for controlling the corresponding driving circuit on the basis of the count value of each heat accumulation counter.

DETAILED DESCRIPTION OF THE INVENTION

Hereinafter, a preferred embodiment of the present invention will be explained in detail with reference to the drawings.

Figure 5:
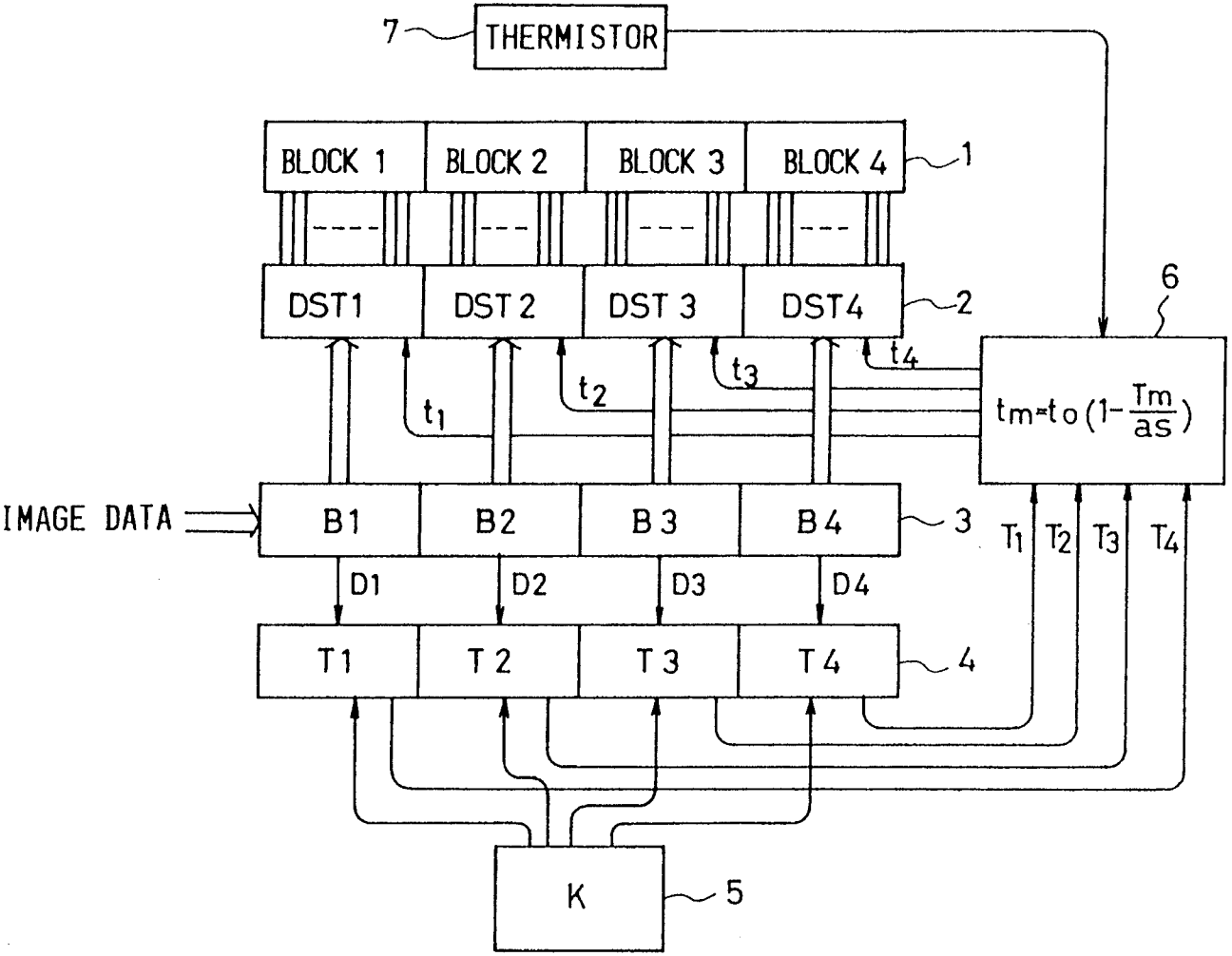
FIG. 5 is a block diagram showing an embodiment of a line thermal printer in accordance with the present invention.

FIG. 5 is a block diagram showing an embodiment of a line thermal printer. As shown in the drawing, a line thermal head 1 consists of four blocks. Each block is disposed on a line and contains a predetermined number of heat generation elements, such as 128 elements that are disposed on a line. A driving circuit 2 has four driving circuit blocks or units DST1, DST2, DST3 and DST4 that correspond to the four blocks of the thermal head 1, respectively. A dot data memory 3 has four dot data memory blocks or areas B1, B2, B3 and B4 that correspond to the driving circuit units, respectively. A heat accumulation counter 4 has four heat accumulation counter blocks or units T1, T2, T3 and T4 that correspond to the four dot data memory areas, respectively. Here, an mth (m=1, 2, 3, 4) heat accumulation counter unit Tm accepts the number Dm of corresponding printing dot data from the mth dot data memory area Bm for each line sequence printing and adds them cumulatively. This line sequence printing is effected in a cycle of 2.5 ms, for example. A multiplier 5 is connected to each unit of the heat accumulation counter 4 and multiplies repeatedly the cumulative count value of each unit by a heat radiation constant K in a predetermined cycle such as 1 ms.

An arithmetic unit 6 is connected to each unit of the heat accumulation counter 4, accepts a correction-updating count value Tm (m=1, 2, 3, 4) from each heat accumulation counter unit and calculates a power supply pulse width tm for each unit of the driving circuit 2 for each line sequence printing in accordance with the following relational formula:

$$tm = t_0\left(1 - \frac{Tm}{aS}\right)$$

At this time the arithmetic unit 6 decides a predetermined reference power supply pulse width $t_0$for each line sequence printing on the basis of the temperature data of the line thermal head 1 outputted from the thermistor 7. Finally, each unit of the driving circuit 2 supplies the power supply pulse to the corresponding block of the line thermal head 1 on the basis of the power supply pulse width data tm that is calculated, and executes line printing.

Next, the operation of the embodiment shown in FIG. 5 will be explained in detail. To begin with, a simulated operation of the surface temperature of the heat generation elements of the line thermal head which is executed by the combination of the heat accumulation counter 4 and the multiplier 5 will be explained.

It will be assumed that a heat radiation constant is K, a printing cycle is tp, a heat radiation cycle is ts and the number of printing dot data is D. In accordance with a predetermined program, D is added to the heat accumulation counter T for each tp (T=T−D) and the heat accumulation counter T is multiplied by the heat radiation constant K for each ts (T=T×K).

A heating value d per unit time is expressed by $$d = \frac{D}{tp}$$

Since the heat radiation value k per unit time is $$K = k^{ts},$$

k is given as follows:

$$k = K^{1/ts}$$

T per unit time changes as follows:

$$T_0 = 0$$
$$T_1 = (T_0 + d)k = dk$$
$$T_2 = (T_1 + d)k = (dk - d)k = dk^2 - dk$$

$$T_n = dk^n - dk^{n-1} + \ldots - dk = d\sum_{i=1}^{n} k^i$$

The difference of n, n−1 is integrated as a differential.

$$\frac{dT}{dn} = d\sum_{i=1}^{n} k^i - d\sum_{i=1}^{n-1} k^i = dk^n$$

$$T(X) = \int_0^N dk^n dn = d\int_0^x k^n d^n$$
$$= \left[\frac{d}{\ln k} k^n - C\right]_0^x = \frac{d}{\ln k}(k^x - 1)$$

Here, since $$d = \frac{D}{tp}$$

and $k = K^{1/ts}$, T(x) can be expressed as follows:

$$T(x) = \frac{d}{\ln k}(k^x - 1)$$
$$= \frac{D/tp}{tp\ln k}(K^{x/ts} - 1)$$
$$= \frac{tsD}{tp\ln k}(K^{x/ts} - 1)$$

The saturation value can be expressed by the following equation (K<1):

$$\lim_{x\to\infty} T(x) = \lim_{x\to\infty} \frac{tsD}{tp\ln k}(K^{x/ts} - 1)$$
$$= -\frac{tsD}{tp\ln k}$$

In other words, when D dots are printed every time during printing (during heating), the content of the heat accumulation counter in the course of x hours can be expressed as follows:

$$T(x) = \frac{tsD}{tp\ln k}(K^{x/ts} - 1)$$

The saturation value S can be expressed as follows:

$$S = -\frac{tsD}{tp\ln k}$$

The saturation value is proportional to the power supply dot number D applied each time.

On the other hand, only heat radiation occurs at times other than at the time of printing and heat radiation attenuates from T' with $T(x)=T'K^{x/ts}$.

Characteristics of absorption and radiation of heat are generally said to be exponential functions and it is expected that the heat accumulation state can be approximated by this simulation.

As has been explained with numerical expressions, the heat accumulation state of the line thermal head with time can be estimated with fidelity by relatively simple operational processing. Repeated multiplication processing of the heat radiation constant K is executed in a predetermined cycle ts such as 1 ms. On the other hand, line sequence printing is executed in a different predetermined cycle tp such as 2.5 ms. The cycle of multiplication processing and the heat radiation constant can be determined experimentally, and the line sequence printing cycle is set by the specification of the line thermal printer. In this manner, both cycles are mutually independent. Accordingly, timer interrupt processing is made practically on the program and repeated multiplication of the heat radiation constant is conducted.

Figure 6:
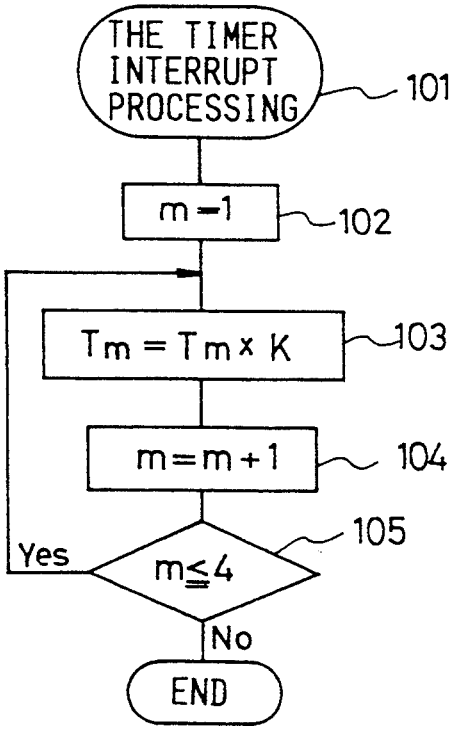
FIG. 6 is a flowchart showing timer interrupt processing.

FIG. 6 shows a flowchart of such a timer interrupt processing. As shown in the chart, the timer interrupt processing is called every 1 ms at Step 101. An index m representing the number of each block is set to 1 at Step 102. The count value Tm of each heat accumulation counter is multiplied by the heat radiation constant K and the count value is updated at Step 103. The index m is incremented at Step 104 and whether or not the index m is below 4 is judged at Step 105. Multiplication processing is conducted sequentially for each block until the index m exceeds 4 and when the multiplication processing is judged to be completed for the four blocks at Step 105, the timer interrupt processing is completed.

Figure 7:
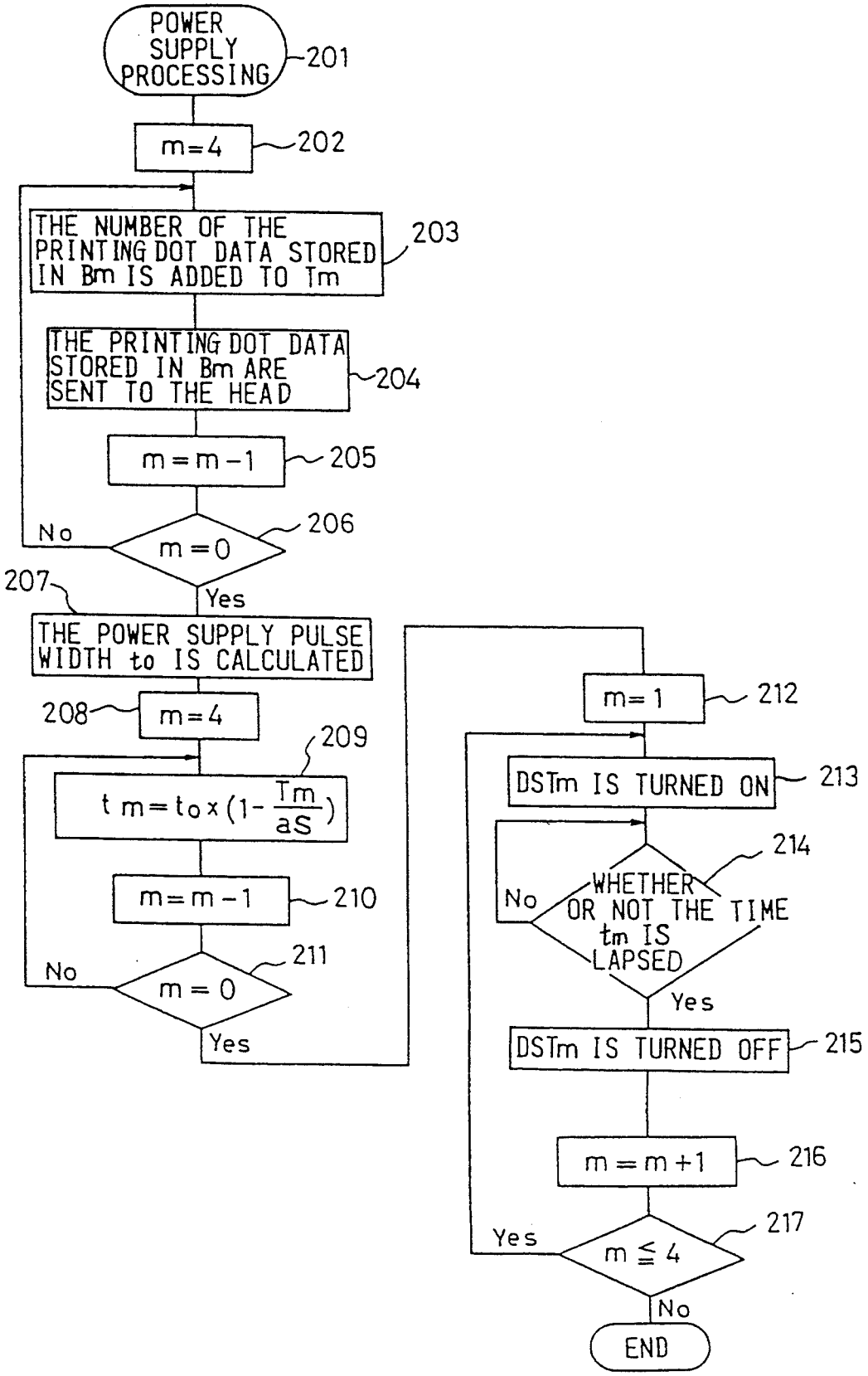
FIG. 7 is a flowchart showing power supply processing.

Finally, the operation of the arithmetic unit 6 will be explained in detail. The arithmetic unit 6 controls the printing exothermic quantity on the heat accumulation state of the line thermal head 1 estimated from the heat accumulation counter 4 and operates so as to keep constant the surface temperature of the heat generation elements of the line thermal head by so-called "feedback". Generally, the exothermic quantity is proportional to the power supply time. Therefore, in the present invention, the arithmetic unit 6 controls the power supply pulse width on the basis of the output count value of the heat accumulation counter 4. FIG. 7 shows a control method of the power supply pulse width. As shown in the drawing, power supply processing is called in every predetermined line sequence printing period and executed if any printing dot data exist, at Step 201. The number of blocks of the line thermal head (4, in this embodiment) is set to the index m at Step 202. Next, the number of the printing dot data stored in the mth area Bm of the dot data memory 3 is added to the corresponding heat accumulation counter unit Tm at Step 203. At this time the printing dot data stored in the memory area Bm at Step 204 are sent simultaneously to the corresponding driving circuit unit DSTm. The index m is decremented at the next Step 205. Addition processing is executed for all the blocks until the index m becomes 0 at Step 206.

After the addition processing for all the blocks is completed, the reference power supply pulse width $t_0$ is calculated at Step 207. This reference power supply pulse width $t_0$ is calculated on the basis of the temperature of the line thermal head which is detected by the thermistor 7 and on the magnitude of the driving voltage supplied to the line thermal head. Generally, the reference power supply pulse width $t_0$ is set to a smaller value when the detection temperature is higher. In this manner the control is made not only by the count value of the heat accumulation counter but also by the detection temperature by the thermistor so that a stable printing operation can be made. Particularly because the detection temperature of the thermistor is utilized, reliability of control based on the count value of the heat accumulation counter is compensated for. The index m is set to 4 at Step 208. Next, the effective power supply pulse width tm is calculated for each block in accordance with the following relational formula at Step 209:

$$tm = t_0 \times \left(1 - \frac{Tm}{aS}\right)$$

After the power supply pulse width tm is calculated for each block at Step 209, the index m is decremented at Step 210. Whether or not the index m is equal to 0 is judged at Step 211 and the calculation of the power supply pulse width tm is repeated until m becomes 0. As described above, since the optimum power supply pulse width is calculated for each block, a more accurate control which insures a uniform printing density in the transverse direction of a sheet can be conducted.

Finally, the index m is set to 1 at Step 212. Each driving circuit unit DSTm is turned ON at Step 213. Whether or not the calculated power supply time lapses is judged on the basis of the power supply pulse width data tm allocated to the driving circuit unit DSTm at Step 214. At the point when the time lapses, DSTm is turned OFF at Step 215 and the index m is incremented at Step 216. Similarly, the next driving circuit unit is operated. Finally, one line printing is completed by confirming that the index m exceeds 4 at Step 217.

Figure 1:
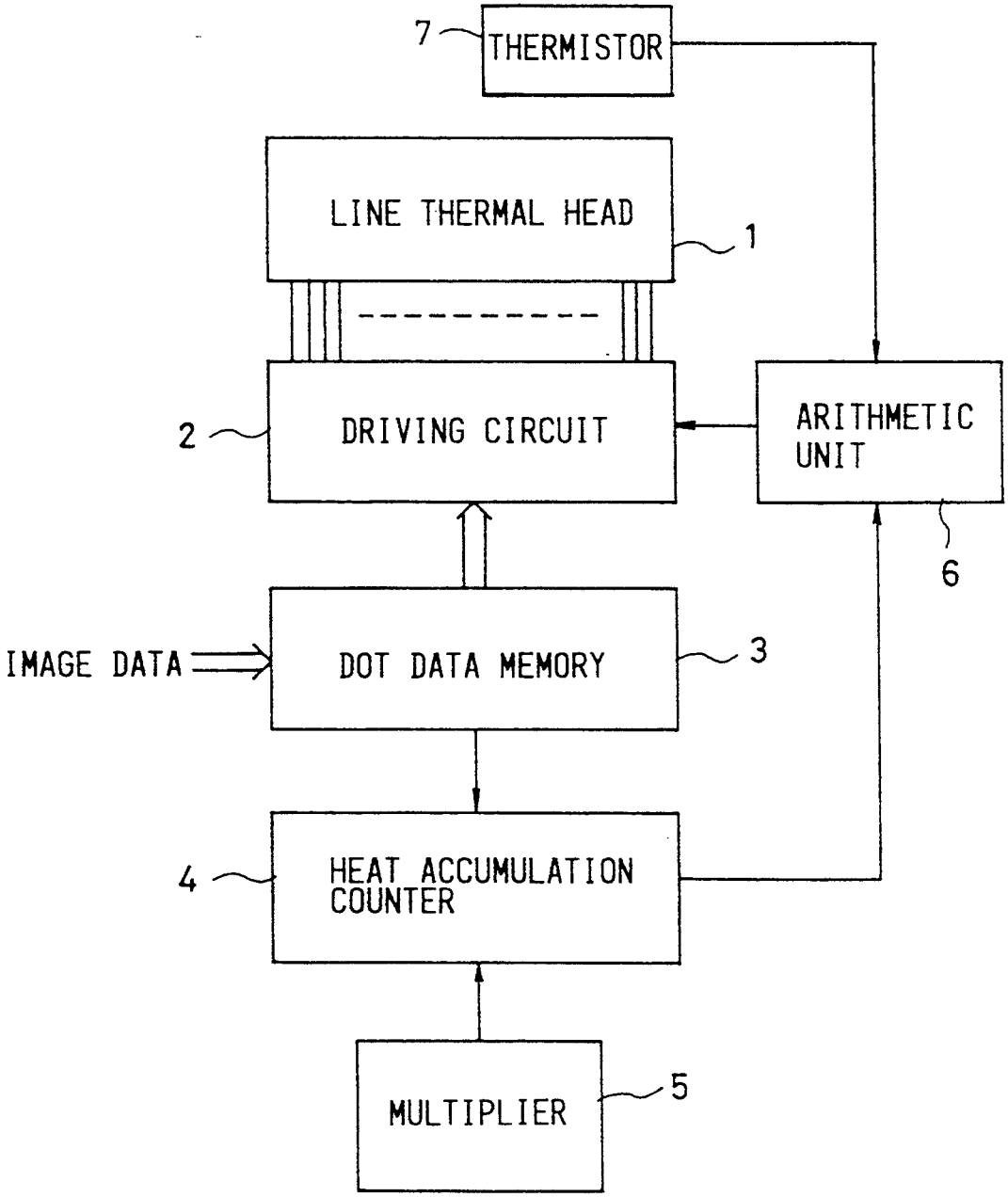
FIG. 1 is a block diagram showing a fundamental electric construction of a line thermal head.
Figure 2:
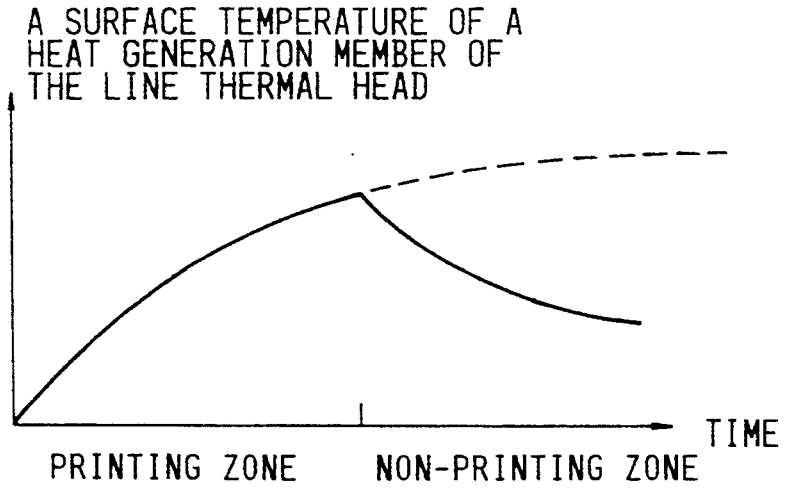
FIG. 2 is a graph showing the change, with time, of the surface temperature of a heat generation member of the line thermal head.

FIG. 2 shows the change of the surface temperature of a heat generation element of the thermal head with time from the start till suspension of printing. As shown in the diagram, the exothermic heat quantity for each line is accumulated when printing is started and the surface temperature of the heat generation element of the head rises. When line sequence printing is continued as such, the temperature approaches saturation as represented by a dotted line. However, when printing is suspended and a non-printing zone is entered, the surface temperature of the heat generation element of the thermal head drops exponentially due to heat radiation. Such a change of the surface temperature cannot be detected on a real time basis by the thermistor. This is because of the response delay in heat conduction that has been heretofore described with reference to the prior art technique.

Figure 3:
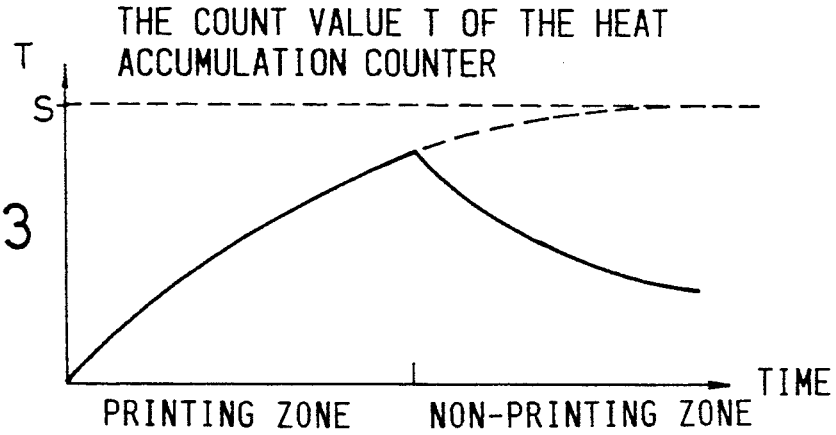
FIG. 3 is a graph showing the change, wity time, of the count value T of the heat accumulation counter.

FIG. 3 is a graph showing the change of the count value T of the heat accumulation counter with time that constitutes a main feature of the present invention. When printing is started, the number of printing dot data for each line printing is added cumulatively to the heat accumulation counter as shown in the graph. For this reason the count value of the heat accumulation counter rises in the printing zone. At this time the count value of the heat accumulation counter is multiplied by the heat radiation constant that is repeated always in a predetermined cycle and has a numeric value of below 1. Accordingly, the count value does not continue to rise even if printing is continued as such but reaches a predetermined saturation count value S as represented by a dotted line. When printing is suspended as shown in the graph, the count value of the heat accumulation counter is no longer added cumulatively in the non-printing zone but is merely multiplied repeatedly by the heat radiation constant. Therefore, the heat accumulation counter count value drops exponentially. As can be seen clearly from the comparison of FIG. 2 with FIG. 3, therefore, the count value T of the heat accumulation counter in the present invention represents with high fidelity the surface temperature of the heat generation element of the thermal head.

As can be understood clearly from the description given above, the number of printing dot data is added cumulatively to the heat accumulation counter for each line sequence line printing as heat accumulation of the line thermal head is effected proportionally to the accumulation number of the heat generation elements to which power is supplied. The heat accumulation counter is multiplied repeatedly by the heat radiation constant below 1 in a predetermined cycle in the corresponding arrangement that the heat radiation characteristics of the line thermal head are exponential. As a result, the corrected and updated count value of the heat accumulation counter reflects with high fidelity the actual surface temperature of the heat generation element of the line thermal head.

Figure 4:
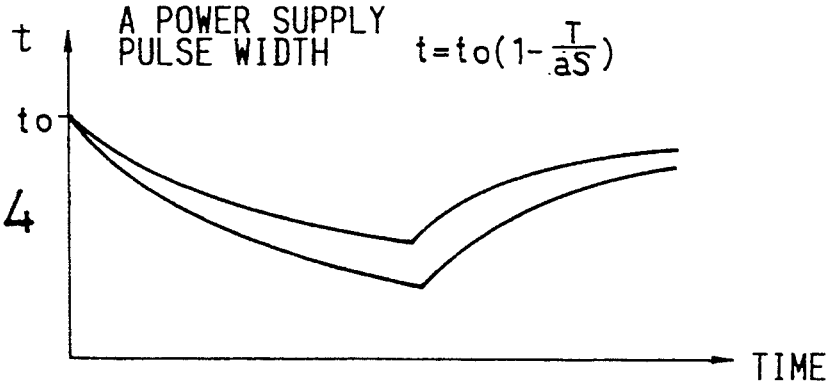
FIG. 4 is a graph showing the change of a power supply pulse width with time.

Next, the power supply pulse width t is calculated for each line sequence line printing on the basis of such a corrected and updated count value. FIG. 4 is a graph showing the change of the power supply pulse width t thus calculated with the passage of time. This power supply pulse width t is calculated by the arithmetic unit 6 in accordance with the following relational formula:

$$t = t_0\left(1 - \frac{T}{aS}\right)$$

The graph shown in FIG. 4 is calculated in such a manner as to correspond to the change of the count value T of the heat accumulation counter shown in FIG. 3. As shown in the graph, the power supply pulse width t drops with the rise of the count value T and rises with the drop of the count value T. The degree of this change of rise and fall can be set suitably by the coefficient a. As can be understood clearly from the comparison of the graph of FIG. 2 with that of FIG. 4, the power supply pulse width t is set in accordance with the present invention in such a manner as to offset the change of the surface temperature of the heat generation element of the line thermal head. If the coefficient a is set appropriately, it becomes possible eventually to keep virtually constant the surface temperature of the heat generation element in real time.

In accordance with the present invention as described above, the heat accumulation condition of the line thermal head is always estimated by adding cumulatively the power supply printing dot data number of each block of the line thermal head to the heat accumulation counter whenever line printing is made, and the heat accumulation counter corresponding to each block is multiplied by the heat radiation constant of below 1 in a predetermined cycle. Power supplied to the line thermal head is controlled on the basis of the result of estimation. Therefore, the present invention provides the effect that the printing density can be kept constant more stably and more effectively than in the prior art devices.

What is claimed is:

1. A line thermal printer comprising:

a line thermal head for effecting dot printing in line sequence for each line in response to a power supply pulse having a pulse width;

a driving circuit for selectively supplying the power supply pulse to said line thermal head in accordance with printing dot data;

a dot data memory for storing a number of printing dot data for each line in synchronism with line sequence printing and for sending the stored printing dot data to said driving circuit;

a heat accumulation counter for measuring the number of printing dot data for each line from the dot data memory and counting the measured numbers cumulatively to provide a count value;

a multiplier for multiplying repeatedly the count value of said heat accumulation counter by a heat radiation constant in a predetermined cycle so as to correct and update the count value; and an arithmetic unit for calculating the pulse width of the power supply pulse in synchronism with line sequence printing and based on the count value of said heat accumulation counter which is corrected and updated, and for controlling said driving circuit based on the calculated pulse width of the power supply pulse.

2. A line thermal printer according to claim 1, wherein said arithmetic unit includes means for calculating the power supply pulse width in accordance with the following relational formula:

$$t = t_0\left(1 - \frac{T}{aS}\right)$$

where t is the power supply pulse width, $t_0$ is a predetermined reference power supply pulse width, T is a corrected and updated count value of the heat accumulation counter, S is a predetermined saturation count value of the heat accumulation counter and a is a predetermined coefficient.

3. A line thermal printer according to claim 2, wherein said line thermal head exhibits a varying temperature during use; and including a thermometer disposed in close proximity to said line thermal head to detect the temperature of said line thermal head; and wherein said arithmetic unit has means for determining said predetermined reference power supply pulse width $t_0$ based on the detected temperature of said line thermal head.

4. A line thermal printer according to claim 1, wherein said line thermal head is divided into a plurality of blocks; said driving circuit, said dot data memory and said heat accumulation counter are divided into plural blocks corresponding to respective ones of the thermal head blocks, each heat accumulation counter block providing a counter value for a respective one of the dot data memory blocks; and said arithmetic unit includes means for controlling corresponding ones of said blocks of said driving circuit according to the count value of each of said heat accumulation counter blocks.

5. A line thermal printer comprising: a plurality of heat-generating means operative when supplied with electric power for generating heat energy to effect dot printing on a line; driving means for selectively supplying electric power pulses having a pulse width to the heat-generating means in accordance with printing dot data applied thereto to effect line sequence dot printing; dot data memory means for storing printing dot data corresponding to a number of printing dots to be printed for each line of print and applying the stored printing dot data to the driving means; counting means for cumulatively counting the number of printing dots in the printing dot data stored in the dot data memory means for each line of print and providing a cumulative count value; and circuit means for adjusting the cumulative count value by multiplying repeatedly the cumulative count value by a heat radiation constant and for controlling the electric power applied to each of the plurality of heat-generating means in accordance with the adjusted cumulative count value.

6. A line thermal printer according to claim 5; wherein the circuit means includes means for adjusting the cumulative count value based on a predetermined heat radiation constant.

7. A line thermal printer according to claim 6; wherein the circuit means includes multiplying means for repeatedly multiplying the cumulative count value by the heat radiation constant at a predetermined rate to repeatedly update the cumulative count value, and means for controlling the electric power supplied to the individual heat-generating means for each line of print in accordance with the updated cumulative count value.

8. A line thermal printer according to claim 7; wherein the means for controlling the electric power includes means for calculating the pulse width of power pulses supplied to the driving means for each line of print in accordance with the updated cumulative count value.

9. A line thermal printer according to claim 8; wherein the means for calculating comprises arithmetic means for calculating the pulse width of the power pulses.

10. A line thermal printer according to claim 8; including means for detecting the temperature in close proximity to the heat-generating means; and wherein the means for calculating includes means for calculating the pulse width of the power pulses according to the detected temperature and the updated cumulative count value.

11. A line thermal printer according to claim 8; wherein the means for calculating comprises arithmetic means for calculating the pulse width of the power pulses according to the expression:

$$t = t_0\left(1 - \frac{T}{aS}\right)$$

where t=the pulse width of the power pulses, $t_0$=a predetermined reference pulse width, T=the updated cumulative count value, S=a predetermined saturation count value of the counting means, and a=a predetermined coefficient.

12. A line thermal printer according to claim 11; including means for detecting the temperature in close proximity to the heat-generating means; and wherein the arithmetic means includes means for determining the value of the predetermined reference pulse width $t_0$ based on the detected temperature.

13. A method for controlling a line thermal printer to effect dot printing on lines successively, comprising the steps of:

storing printing dot data containing a number of printing dots in a dot data memory means;

supplying the stored printing dot data to a driving means;

counting cumulatively the number of printing dots in the printing dot data stored in the dot data memory means for each line of print to produce a cumulative count value;

updating repeatedly the cumulative count value by multiplying repeatedly the cumulative count value by a predetermined heat radiation constant; and calculating a pulse width of power pulses supplied to the driving means for each line of print based on the updated cumulative count value.

14. A method for controlling a line thermal printer according to claim 13; wherein the step of calculating comprises calculating the pulse width of the power pulses based on the updated cumulative count value and a reference power supply pulse width; and wherein the reference power supply pulse width is determined by detecting a temperature in close proximity to a heat generating means, and determining the reference power supply pulse width based on the detected temperature.

15. A method for controlling a line thermal printer having a line thermal head containing a plurality of heat-generating elements for effecting printing in line sequence in accordance with printing dot data supplied by an outside source, and having driving means for supplying power supply pulses having a pulse width to the line thermal head, the method comprising:

storing printing dot data corresponding to a number of printing dots to be printed for each line of print in a dot data memory means;

supplying the stored printing dot data to the driving means;

counting cumulatively the number of printing dots in the printing dot data stored in the dot data memory means for each line of print;

updating repeatedly the cumulatively counted number of printing dots by performing a mathematical operation on the cumulatively counted number of printing dots; and calculating the pulse width of each of the power supply pulses supplied to the driving means for each line of print in accordance with the updated cumulatively counted number of printing dots and a predetermined reference pulse width.

16. A method according to claim 15; wherein the performing of the mathematical operation comprises multiplying repeatedly the cumulatively counted number of printing dots by a predetermined heat radiation constant.

17. A method according to claim 15; including detecting a temperature in close proximity to the heat-generating elements; and determining the reference pulse width based on the detected temperature.

18. A method according to claim 17; wherein detecting the temperature comprises detecting the temperature by a thermistor disposed in close proximity to the heat-generating elements.

* * * * *